US010413770B2

(12) United States Patent
Gustafson

(10) Patent No.: US 10,413,770 B2
(45) Date of Patent: Sep. 17, 2019

(54) POWER ARC EXERCISE DEVICE

(71) Applicant: Norman Paul Gustafson, Dunedin, FL (US)

(72) Inventor: Norman Paul Gustafson, Dunedin, FL (US)

( * ) Notice: Subject to any disclaimer, the term of this patent is extended or adjusted under 35 U.S.C. 154(b) by 269 days.

(21) Appl. No.: 15/731,573

(22) Filed: Jul. 3, 2017

(65) Prior Publication Data

US 2019/0001176 A1 Jan. 3, 2019

(51) Int. Cl.
*A63B 21/05* (2006.01)
*A63B 21/04* (2006.01)
(Continued)

(52) U.S. Cl.
CPC .... *A63B 21/0442* (2013.01); *A63B 21/00069* (2013.01); *A63B 21/023* (2013.01); *A63B 21/05* (2013.01); *A63B 21/055* (2013.01); *A63B 21/151* (2013.01); *A63B 21/16* (2013.01); *A63B 21/1645* (2013.01); *A63B 21/4035* (2015.10); *A63B 21/4045* (2015.10); *A63B 23/0205* (2013.01); *A63B 23/0233* (2013.01); *A63B 23/1209* (2013.01); *A63B 69/0002* (2013.01); *A63B 69/36* (2013.01); *A63B 69/38* (2013.01); *A63B 71/0622* (2013.01); *A63B 2069/0008* (2013.01); *A63B 2071/0694* (2013.01);
(Continued)

(58) Field of Classification Search
CPC ..... A63B 21/0442; A63B 23/0205; A63B 21/023; A63B 71/0622; A63B 23/0233; A63B 21/4035; A63B 21/00069; A63B 69/38; A63B 21/16; A63B 21/05; A63B 69/36; A63B 21/4045; A63B 23/1209; A63B 21/055; A63B 21/151; A63B 69/0002; A63B 21/1645; A63B 2069/0008; A63B 2071/0694; A63B 2225/093; A63B 2225/09; A63B 2210/50
See application file for complete search history.

(56) References Cited

U.S. PATENT DOCUMENTS 3,618,942 A * 11/1971 Bates ..... A63B 21/04 473/229
3,814,084 A * 6/1974 Gustafson ..... A63B 21/154 482/131
(Continued)

*Primary Examiner* — Amy R Weisberg

(57) ABSTRACT

The Power Arc Exercise Device is a portable, lightweight exercise device that strengthens the muscles used in sports requiring strong rotation of the body. Examples of sports that require strong rotation of the trunk and hips include baseball batting, golf and tennis. The Power Arc Exercise Device uniquely exercises the exact muscles used to produce rotation. The Power Arc Exercise Device also provides resistance to the muscles of rotation in an optimum direction. The optimum direction of resistance for any exercise device is a ninety degree angle to the direction of the body's movement. Exercise bands provide linear resistance only to movement that is in a rotary direction and as such do not provide effective resistive exercise. The Power Arc Exercise device enables athletes to maximally strengthen muscles used to develop power and control in their individual sport In addition to strengthening the core muscles of the trunk and hip, the Power Arc Exercise Device also provides strengthening for the arm and hand muscles.

1 Claim, 1 Drawing Sheet

(51) Int. Cl.

| | |
|---|---|
| ***A63B 69/36*** | (2006.01) |
| ***A63B 69/38*** | (2006.01) |
| ***A63B 21/00*** | (2006.01) |
| ***A63B 21/02*** | (2006.01) |
| ***A63B 21/055*** | (2006.01) |
| ***A63B 21/16*** | (2006.01) |
| ***A63B 23/02*** | (2006.01) |
| ***A63B 71/06*** | (2006.01) |
| ***A63B 23/12*** | (2006.01) |
| ***A63B 69/00*** | (2006.01) |

(52) U.S. Cl.
CPC ..... *A63B 2210/50* (2013.01); *A63B 2225/09* (2013.01); *A63B 2225/093* (2013.01)

(56) References Cited

U.S. PATENT DOCUMENTS 4,135,714 A * 1/1979 Hughes ..... A63B 21/04 473/229
4,253,663 A * 3/1981 Hughes ..... A63B 21/04 482/127
4,477,073 A * 10/1984 Koch ..... A63B 21/1627 482/129
5,468,205 A * 11/1995 McFall ..... A63B 21/0552 482/121
6,612,972 B1 * 9/2003 Reichard ..... A63B 21/018 482/131
6,692,415 B1 * 2/2004 Winston ..... A63B 21/0004 482/122
6,705,976 B1 * 3/2004 Piane, Jr. ..... A63B 21/154 482/102
7,056,224 B1 * 6/2006 Keyes ..... A63B 21/154 473/229
7,806,780 B1 * 10/2010 Plunkett ..... A63B 69/3641 473/229
8,282,500 B1 * 10/2012 Masching ..... A63B 21/0442 473/219
2002/0119869 A1 * 8/2002 Whited Lake ..... A63B 21/154 482/93
2003/0109321 A1 * 6/2003 Novotny ..... A63B 21/4017 473/219
2004/0033869 A1 * 2/2004 Carlson ..... A63B 21/023 482/121
2009/0239720 A1 * 9/2009 Osbak ..... A63B 21/055 482/112
2011/0230315 A1 * 9/2011 Castillo ..... A63B 21/023 482/94
2014/0162857 A1 * 6/2014 Shade ..... A63B 23/1236 482/141
2015/0367173 A1 * 12/2015 Ellis ..... A63B 21/4047 482/127
2016/0243396 A1 * 8/2016 Taylor ..... A63B 21/4049
2017/0209728 A1 * 7/2017 Lagree ..... A63B 21/023
2018/0311523 A1 * 11/2018 Arturo ..... A63B 21/156
2018/0318631 A1 * 11/2018 Siu ..... A63B 21/4007
2019/0111305 A1 * 4/2019 Robinson ..... A63B 21/4047

* cited by examiner

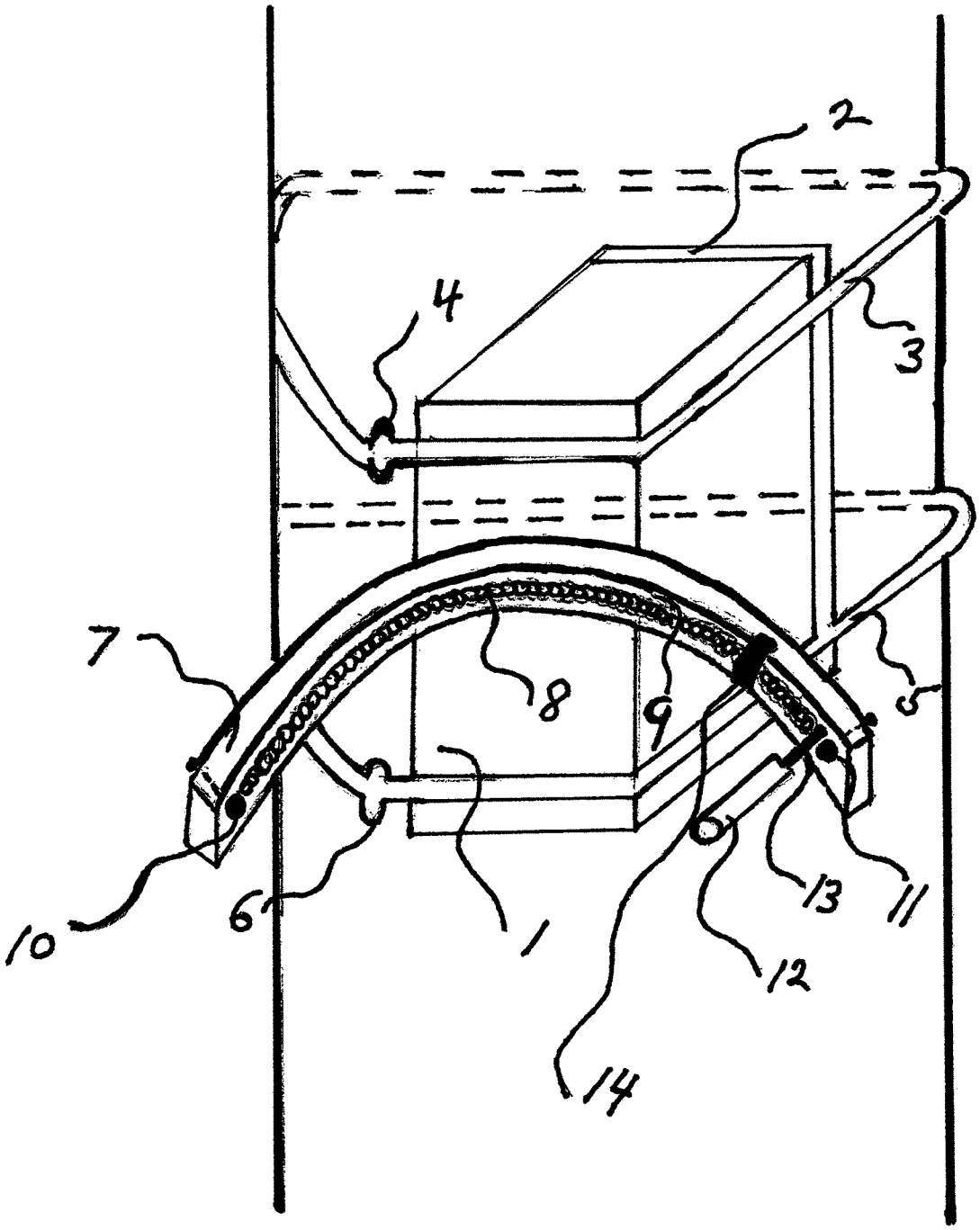
2
4
3
7
8
9
5
10
6
1
13
11
12
14

POWER ARC EXERCISE DEVICE

FIELD OF INVENTION

Participation in sports is an important part of our society. The desire to improve performance in sports has generated the development of various exercise regimens and exercise devices. A current concept in sports training is termed functional training. Functional training suggests that the primary movement/s required to perform the sport be represented in the strengthening program the athlete participates in to improve performance in the sport. The current invention relates to a device that strengthens the core muscles of the body used in sports that require a strong rotary movement of the body about a vertical axis. These sports include baseball, golf, and tennis among others. In addition to providing functional exercise for these sports, the current invention also provides exercise for anyone wishing to strengthen the core muscles of the body that produce spinal and hip rotation.

DESCRIPTION OF PRIOR ART

There are various devices that are commercially available that are designed to provide strengthening exercise for the sports of baseball, golf and tennis. These devices generally use exercise bands to provide resistance. Resistance bands exert their pull in a linear direction, while baseball batting, a golf swing and a tennis stroke are all examples of rotary movement. Resistance bands are therefore incapable of providing the optimum direction of resistance to the athlete's functional movement. A need exists therefore for a device that can effectively provide resistive strength training for athletes who participate in baseball, golf, tennis and other sports that require strong rotation of the spine and hip.

OBJECTS AND ADVANTAGES

It is an object of the current device to provide gradable resistance to spinal and hip rotation. It is a further object of the current invention to provide a device that can provide functional strength training for athletes desiring to improve their ability in baseball, golf, tennis and other sports.

It is a further object of the current invention to provide a device that can be easily mounted to a door or a fence so that exercise can be performed inside or outside.

An additional object of the current device is to provide a device that can easily resist the movements of both clockwise and counterclockwise rotation of the spine and hip.

It is a further object of the current device to provide exercise for the muscles of the upper extremity used in sports such as baseball, golf and tennis.

BRIEF DESCRIPTION OF DRAWINGS

FIGURE one shows a perspective view of the invention

DRAWING LIST

1. Base
2. Door contacting foam on base
3. Top Strap
4. Cam buckle on top strap
5. Bottom strap
6. Cam buckle on bottom strap
7. Curved track
8. Resistance Spring

9. Slot in curved track
10. Left side spring stop bolt and nut
11. Right side spring stop bolt and nut
12. Handle
13. Spring contact member on handle
14. Progress indicator

DESCRIPTION OF PREFERRED EMBODIMENT

A preferred embodiment of the current invention is described below. Please note that other embodiments of the current invention could be deployed. For example in a modified embodiment the curved track could be adjustably mounted on the base so that the curved track could be positioned in varying planes and then secured again to the base during use. The preferred embodiment of the current invention includes a base 1. A door contacting foam piece 2 is permanently attached to the rear of the base. This door contacting foam is interposed between the base and the door the invention is mounted to. The door contacting foam allows for secure attachment of the base to the door. The base 1 is secured to a door by using a top strap 3 and a bottom strap 4 which are permanently attached to the base.

The straps are routed behind a door and then tightened with the use of a cam buckle on top strap 5 and cam buckle on bottom strap 6. In this way the invention can be attached to a door in a secure manner without damaging the door. A curved track 7 is attached securely with hardware to the base. As mentioned above in another embodiment of the invention a ball and socket joint could be employed to vary the orientation of the curved track before securing it to the base. For the application of golf training for example the curved track is not oriented in the horizontal plane. The plane orientation of the curved track for golf is set to match the plane of a typical golf swing from around 35 degrees before impact to around 35 degrees after impact. A resistance spring 8 is mounted inside the hollow curved track. The resistance spring can be of varying compressive strength to meet the varying strength profiles of individual users. At the left end of the curved track there is a left side spring stop bolt and nut 10 and there is a right side spring stop bolt and nut 11 at the right end of the track. The slot in curved track provides an opening so that a spring contact member 12 can be inserted against one side of the resistance spring. Note: exercise with the invention can be produced from right to left or from left to right depending on which side of the resistance spring the spring contact member is placed against. Rigidly attached to the spring contact member is a handle 13. The user grasps the handle during use to move the resistance spring in the curved track. A progress marker 14 is positioned over the curved track and against the spring contact member and the handle. During use motion of the handle from right to left or from left to right also moves the progress marker along the curved track.

Operation:

In a typical operation of the invention, the base 1 is positioned on a door with the door contact foam 2 interposed between the base and the door. The base can be oriented on the door in a preferred vertical position depending on the user's height. The base is secured to the door for use by routing the top and bottom straps 3 and 5 behind the door and then tensioning the straps using the cam buckle on top strap 4 and the cam buckle on bottom strap 5. The appropriate resistance spring 8 is positioned in the curved track 7 and held in place by inserting and securing the left side securing nut and bolt 10 and the right side spring stop bolt and nut 11. The spring contact member 13 is inserted in the slot in curved track 9. The progress marker 14 is positioned against the handle 12 and spring contact on handle 13. To exercise using the invention the user grasps the handle 12 and using upper extremity muscles and the muscles of trunk and hip rotation, moves the resistance spring 8 within the curved track 7.

I claim:

1. A power arc exercise device comprising: top and bottom straps;

a base configured to be secured to a door for use and to be removed when not in use by said top and bottom straps;

a curved track attached to said base member; a handle further comprising a spring contact member;

wherein said curved track further comprising a slot housing a resistance spring; wherein said slot running most of the length of said curved track allowing for insertion and travel of said spring contact member;

wherein said spring contact member insertable against either side of said resistance spring to permit exercise production from right or left direction when a user grasps the handle during use to move the resistance spring in the curved track;

the radius of said curved track configured to approximate the arc of movement of at least one of an athlete's hands produces while performing his or her sports activity;

wherein a thickness of said base is of sufficient dimension to allow an inward vector force on the base toward the door following tensioning of said top and bottom straps; and wherein the exercise device is configured to permit a user to grasp the handle while exercising to use upper extremity muscles and muscles of the trunk and hip such that rotation moves the resistance spring within the curved track.

* * * * *